US007191522B2

(12) United States Patent
Murzynski et al.

(10) Patent No.: US 7,191,522 B2
(45) Date of Patent: Mar. 20, 2007

(54) CUTTING BLADE AND CUTTING BLADE ASSEMBLY FOR ELECTRIC SHAVER

(75) Inventors: Maciej Murzynski, Verona, WI (US); Giovanni Gonzalez, Sun Prairie, WI (US); Raymond L. Poole, Pleasant Springs, WI (US); David W. Everett, Verona, WI (US)

(73) Assignee: Rovcal, Inc., Madison, WI (US)

( * ) Notice: Subject to any disclaimer, the term of this patent is extended or adjusted under 35 U.S.C. 154(b) by 0 days.

(21) Appl. No.: 11/136,284

(22) Filed: May 24, 2005

(65) Prior Publication Data

US 2005/0274020 A1 Dec. 15, 2005

Related U.S. Application Data

(60) Provisional application No. 60/577,129, filed on Jun. 4, 2004.

(51) Int. Cl.
*B26B 19/04* (2006.01)
*B21D 53/00* (2006.01)

(52) U.S. Cl. ..... 30/43.92; 30/346.51; 30/346.61

(58) Field of Classification Search ..... 30/43.92, 30/346.51, 43.8, 43.9, 43.91; 29/458, 464, 29/467; 427/580, 255.394, 248.1; 76/DIG. 8; 492/14, 39, 40; 83/425.3, 425.4, 508.3; 144/222, 231–233, 237
See application file for complete search history.

(56) References Cited

U.S. PATENT DOCUMENTS 2,900,719 A 8/1959 Kohner et al.
3,064,349 A 11/1962 Futterer et al.
3,178,818 A * 4/1965 Liska ..... 30/346.51
3,409,984 A 11/1968 Futterer
3,553,905 A 1/1971 Lemelson
3,597,844 A 8/1971 Messinger
3,802,078 A 4/1974 Denes
3,900,636 A 8/1975 Curry et al.
4,056,992 A 11/1977 Blume
4,451,984 A * 6/1984 Shimazu ..... 30/346.52
4,470,895 A * 9/1984 Coad et al. ..... 204/192.15

(Continued)

FOREIGN PATENT DOCUMENTS

DE 3431330 A1 3/1986

(Continued)

*Primary Examiner*—Boyer D. Ashley
*Assistant Examiner*—Edward Landrum
(74) *Attorney, Agent, or Firm*—Senniger Powers

(57) ABSTRACT

In a cutting blade assembly for an electric foil shaver, a first cutting blade of the assembly has a generally planar first face, a generally planar second face opposite the first face, and a peripheral cutting edge. The first cutting blade has at least one bump disposed on its first face. A second cutting blade of the assembly has a generally planar first face, a generally planar second face opposite the first face, and a peripheral cutting edge. The first and second cutting blades are arranged in generally parallel relationship with each other with the first face of the first cutting blade facing either the first face or the second face of the second cutting blade. The bump on the first face of the first cutting blade keeps the first and second cutting blades otherwise separated during a coating process in which the faces of the cutting blades are coated.

21 Claims, 11 Drawing Sheets

U.S. PATENT DOCUMENTS 4,536,956 A * 8/1985 Koroncai et al. ..... 30/43.92
4,562,644 A * 1/1986 Hitchens ..... 30/41
4,589,205 A * 5/1986 Tanahashi ..... 30/43.8
4,729,905 A * 3/1988 Zhed et al. ..... 427/581
4,867,223 A 9/1989 Matsumura et al.
5,053,245 A 10/1991 Kiyama et al.
5,074,721 A * 12/1991 Kress et al. ..... 407/119
5,138,767 A 8/1992 Locke
5,458,928 A 10/1995 Kiyama et al.
5,857,260 A 1/1999 Yamada et al.
6,194,088 B1 2/2001 Yoshida et al.
6,354,008 B1 3/2002 Domoto et al.
6,436,546 B1 8/2002 Gulikers et al.
6,532,855 B1 * 3/2003 Ward et al. ..... 83/835
6,601,302 B2 8/2003 Andrew
2004/0006863 A1 1/2004 Otani et al.
2004/0123466 A1 7/2004 Kameoka et al.

FOREIGN PATENT DOCUMENTS

EP 0 633 822 B1 5/1998

* cited by examiner

CUTTING BLADE AND CUTTING BLADE ASSEMBLY FOR ELECTRIC SHAVER

CROSS-REFERENCE

This application claims priority to U.S. Provisional Patent Application Ser. No. 60/577,129 filed Jun. 4, 2004, the entire disclosure of which is incorporated herein by reference.

FIELD OF INVENTION

The present invention relates generally to cutting blade assemblies for electric shavers, and more particularly to cutting blades for such assemblies which are more readily coated with a coating material.

BACKGROUND

Electric shavers are commonly used to shave facial and body hair. Many people prefer electric shavers to razors because the cutting blades of electric shavers do not contact the skin, thereby reducing the risk of nicks, cuts and other skin irritations. One conventional type of electric shaver type is commonly referred to as a foil shaver (FIG. 1), wherein a cutting blade assembly (FIG. 2) comprised of multiple, parallel aligned cutting blades are disposed for joint reciprocation within a thin, flexible apertured foil or mesh screen. The cutting blade assembly is reciprocated relative to the foil, with cutting edges of the blades in contact with the inner surface of the foil, so that the cutting edges of the blades repeatedly cross the apertures formed in the foil. By sliding the outer surface of the foil over the skin surface to be shaven, individual short hairs enter the apertures formed in the foil and are cut by the cutting edges of the reciprocating blades.

Cutting blade assemblies are typically constructed by mounting multiple cutting blades in parallel, spaced relationship with each other on a common support shaft as shown in FIG. 2. The blades may be circular, semi-circular or other shapes. In particular, each of the blades has a peripheral edge that is contoured to correspond generally to the cross-sectional shape of the foil to thereby facilitate flush contact between the blades and the foil. The blades are typically stamped out of a metal strip having a uniform thickness.

It is also known to coat part or all of a cutting blade used in foils shavers with a suitable coating compound, such as a titanium compound, a nickel compound or the like to increase the strength and wear resistance of the blades. In one process, the cutting blade assembly, i.e., with individual cutting blades mounted on a common support shaft in spaced relationship with each other, are subjected to a conventional coating process such as a physical vapor deposition process (PVD) to coat the opposite faces of each cutting blade. However, such a process coats a relatively small number of blades.

It would be desirable to coat the blades prior to assembling the cutting blade assembly. For example, a substantial number of cutting blades are currently loaded onto a wire or thin rod as shown in FIG. 3 following initial forming, but prior to assembling the cutting blade assembly, for ease of storage and transport of the cutting blades. However, effective simultaneous coating of the cutting blades in such an arrangement is difficult because the blades have a tendency to stack against each other on the wire as shown in FIG. 3, thereby inhibiting the opposite faces of the blades from being properly coated.

There is a need, therefore, for cutting blades that more readily remain separated from each other during coating prior to assembly of the cutting blade assembly.

SUMMARY

In general, a cutting blade assembly for an electric foil shaver according to one embodiment of the present invention comprises a first cutting blade having a generally planar first face, a generally planar second face opposite the first face, and a peripheral cutting edge. The first cutting blade has at least one bump disposed on the first face. A second cutting blade has a generally planar first face, a generally planar second face opposite the first face, and a peripheral cutting edge. The first and second cutting blades are arranged in the cutting blade assembly in generally parallel relationship with each other and with the first face of the first cutting blade facing one of the first face and the second face of the second cutting blade.

In one embodiment of a cutting blade for an electric shaver cutting blade assembly that includes multiple cutting blades, the cutting blade has a generally planar first face, a generally planar second face opposite the first face, and a peripheral cutting edge. The cutting blade further has at least one bump on its first face.

A process according to one embodiment of the present invention for coating cutting blades for a cutting blade assembly generally comprises arranging first and second discrete cutting blades on a support member in generally parallel relationship with each other, with each of the first and second cutting blades having a first face and a second face opposite the first face. The arranging step generally comprises arranging the discrete first and second cutting blades relative to each other on the support member such that an outer edge margin of the first face of the first cutting blade is in spaced relationship with a corresponding outer edge margin of the second face of the second cutting blade. The cutting blades are subjected to a coating process to coat the outer edge margins of the first and second faces of each of the first and second cutting blades while the cutting blades remain on the support member. The cutting blades are subsequently removed from the support member and mounted on a cutting blade assembly support in spaced relationship with each other.

BRIEF DESCRIPTION OF THE DRAWINGS

Corresponding reference characters indicate corresponding parts throughout the drawings.

DETAILED DESCRIPTION

Figure 1:
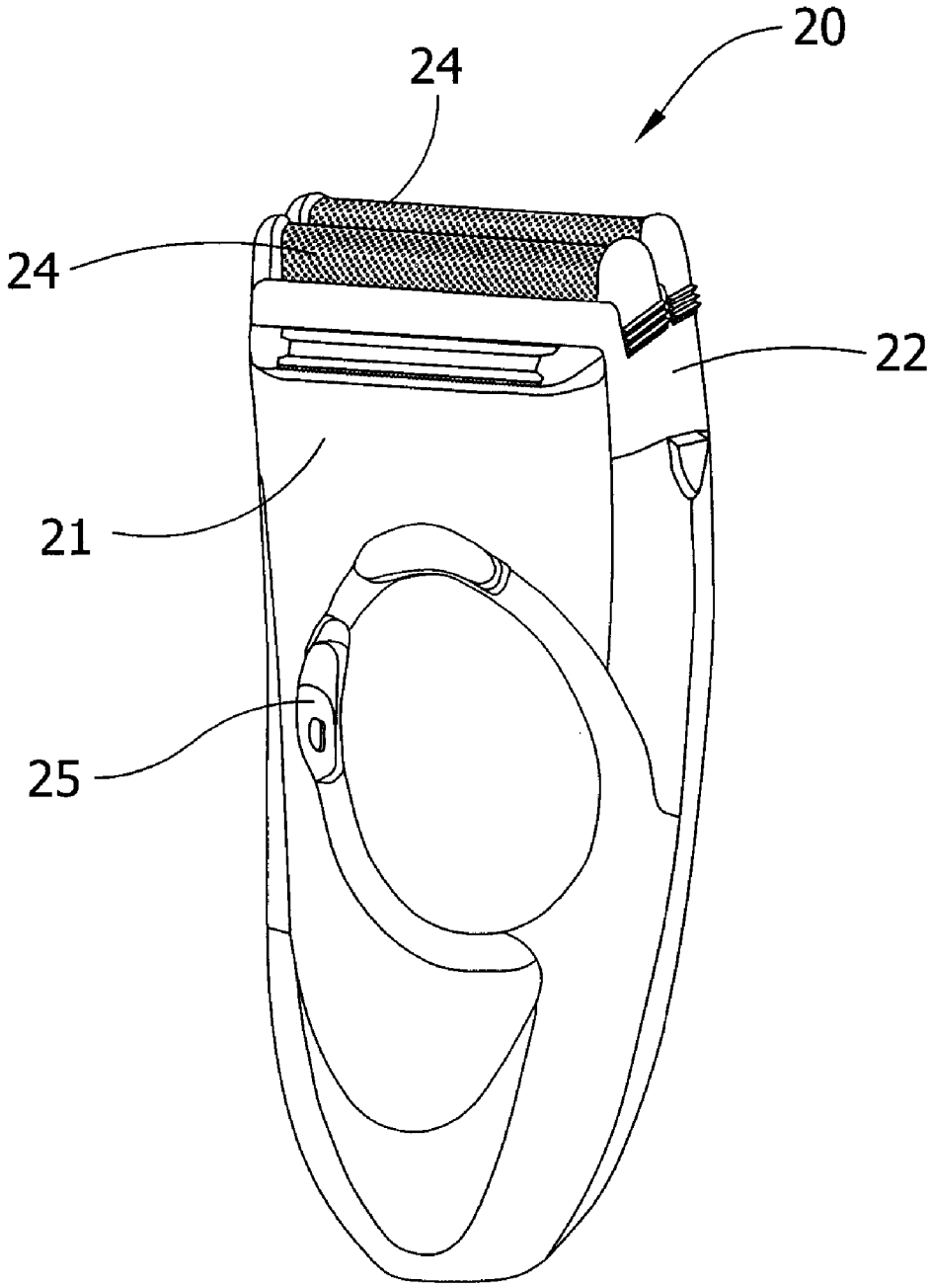
FIG. 1 PRIOR ART
FIG. 1 is a perspective view of a prior art foil-type electric shaver.
Figure 2:
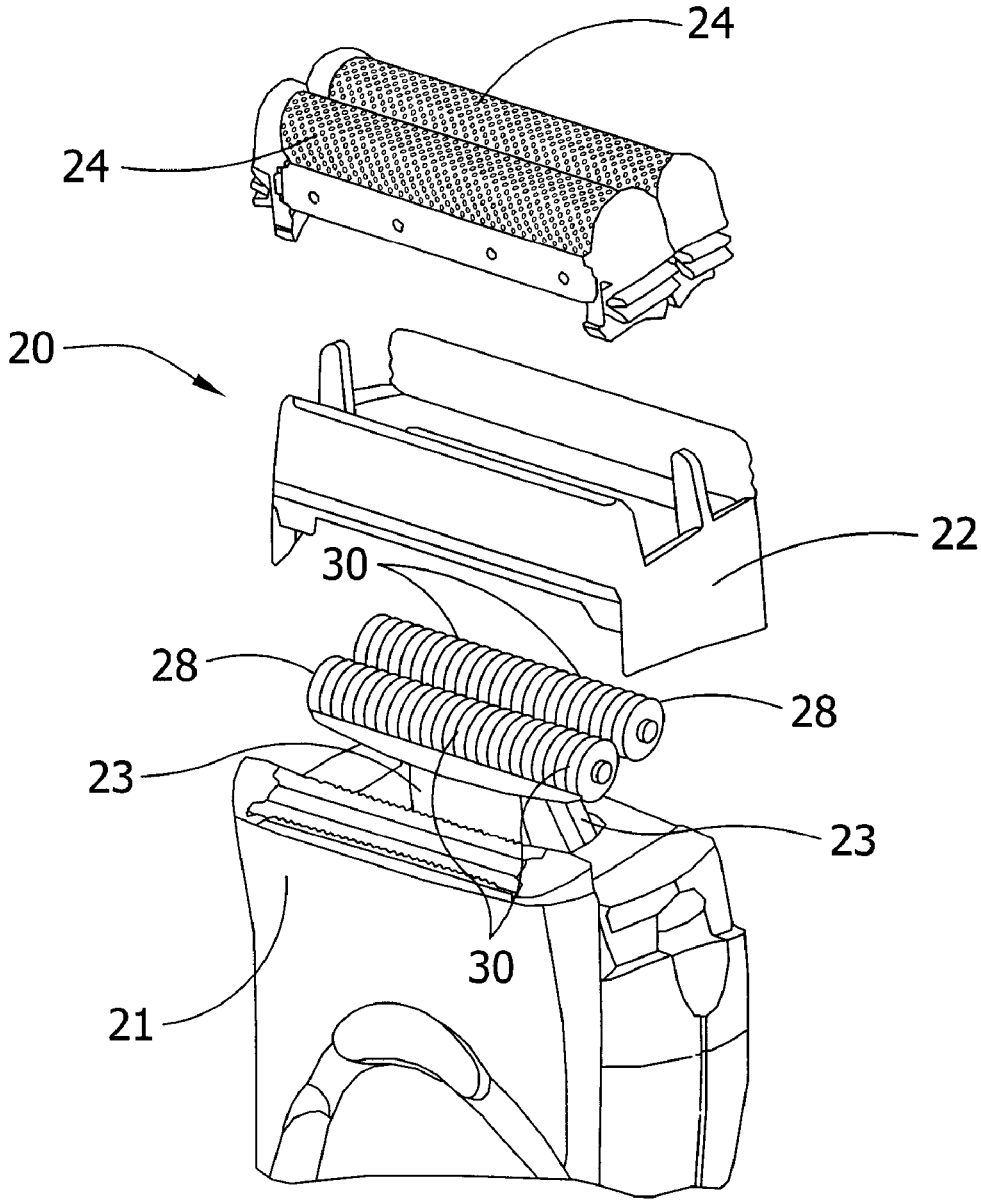
FIG. 2 PRIOR ART
FIG. 2 is a perspective view of the prior art shaver shown in FIG. 1 with portions of the shaver exploded to show internal construction.

Referring now to the drawings and in particular to FIGS. 1 and 2, cutting blades and cutting blade assemblies of the present invention are particularly suited for and are illustrated herein as being incorporated in an electric shaver such as the conventional foil-type shaver (also referred to as a foil shaver) shown in FIG. 1 and indicated generally at 20. The shaver 20 generally comprises a housing 21 and a guard/cover support base 22 releasably mounted thereon to permit removal of the support base for cleaning/changing of various components of the shaver. The housing 21 houses a motor (not shown) which is operatively connected to a pair of carriages 23 (FIG. 2) that are driven by the motor (not shown) to move relative to the housing in a side-to-side reciprocating motion upon operation of the motor. Cutting blade assemblies 28 (FIG. 2) are respectively mounted on each of the carriages 23, with the cutting blade assemblies being separate and independent from each other in parallel spaced relationship.

A pair of apertured foils 24 (also often referred to as mesh screens) are mounted on the guard/cover support base 22 to extend side-to-side in parallel relationship with each other in accordance with the cutting blade assemblies 28. The cutting blade assemblies 28 are suitably biased into contacting, hair cutting relationship with the inner surfaces of the respective apertured foils 24. The apertured foils 24 and cutting blade assemblies 28 are also constructed and arranged to permit flexing movement relative to the housing 21 during use, while the cutting blade assemblies remain in contact with the apertured foils.

Activation of an on/off switch 25 (FIG. 1) operates the motor to drivingly reciprocate the cutting blade assemblies 28 in side-to-side movement while in contact with the inner surfaces of the apertured foils 24. The apertured foils 24 are guided (e.g., in a sliding movement) over the skin surface being shaved to facilitate short hairs extending through the apertures in the foils. As cutting blades 30 of the cutting blade assemblies 28 pass back and forth over the foil apertures while in contact with the inner surfaces of the foils 24, hairs that extend through the apertures are cut by the cutting blades. Further construction and operation of the electric shaver 20 shown in FIG. 1 is described in co-assigned U.S. Pat. No. 6,601,302 (Andrew), the disclosure of which is incorporated herein by reference to the extent it is consistent with the present disclosure.

Figure 3:
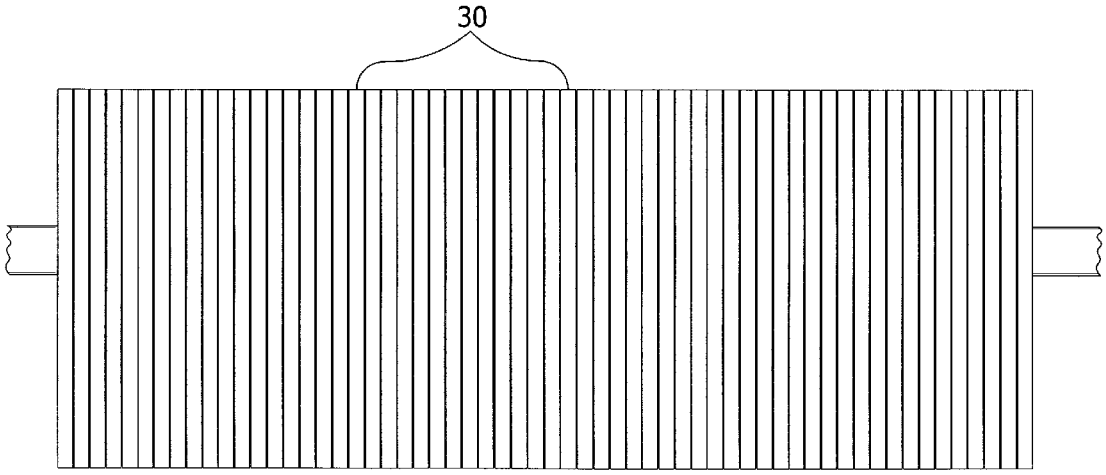
FIG. 3 is a fragmented, front elevation of a plurality of cutting blades loaded on a wire support member for subjecting the cutting blades to a coating process.
Figure 5:
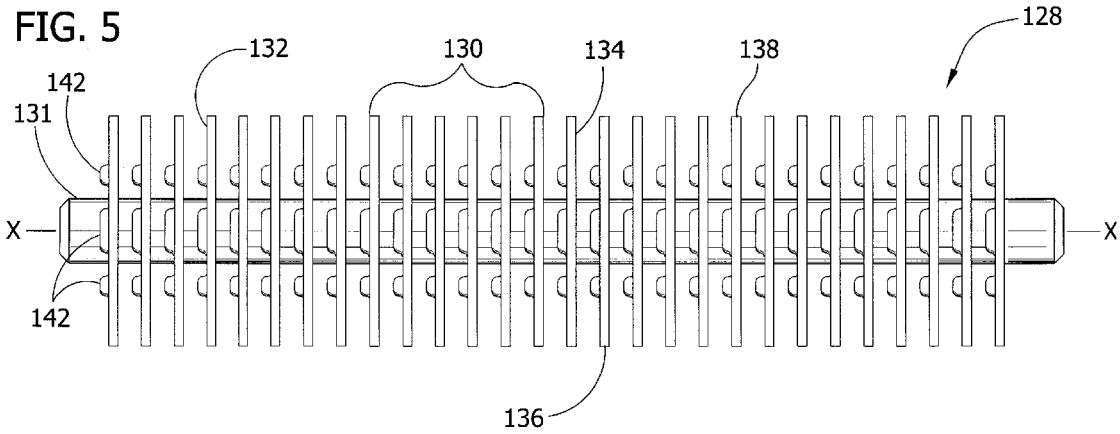
FIG. 5 is a front elevation of a cutting blade assembly according to another embodiment of the present invention.

With particular reference now to FIG. 5, a cutting blade assembly, generally indicated at 128, in accordance with one embodiment of the present invention can be used in place of the cutting blade assembly 28 of the shaver 20 shown in FIG. 1. The cutting blade assembly 128 generally comprises a plurality of discrete cutting blades 130 mounted on a support shaft 131 in parallel spaced relationship with each other along a longitudinal axis X (defined by the support shaft in the illustrated embodiment). The term discrete as used in reference to the cutting blades 130 means that the blades are formed as separate, individual components and not a collective unit prior to mounting on the cutting blade assembly 128. While each cutting blade assembly 128 has a total of 28 cutting blades 130 in the illustrated embodiment of FIG. 3, it is understood that the number of cutting blades on each cutting assembly may vary without departing from the scope of this invention.

Each cutting blade 130 has a generally planar first face 132, a generally planar second face 134 opposite the first face, and a peripheral cutting edge 136. A segment 138 of the peripheral cutting edge 136 of each cutting blade 130 suitably has a contour that generally accords with the contour of the inner surface of the apertured foil 24 to provide a generally flush contact therebetween. In the illustrated embodiment, each cutting blade 130 is generally circular, or disk-shaped, so that an arcuate segment 138 of the peripheral cutting edge 136 of each blade has a contour that matches the contour of the inner surface of the foil 24 regardless of the angular orientation at which the blade is mounted on the support shaft 131. It is understood, however, that the cutting blades 130 need not be circular, such that only a defined segment of the peripheral cutting edge 136 of each cutting blade has the desired contour that accords with the contour of the apertured foil 24. The segment 138 of peripheral cutting edge 136 that contacts the inner surface of the apertured foil 24 broadly defines a cutting edge for cutting hairs that extend through the apertures of the foil.

An opening 139 (FIGS. 6A and 6B) is formed in each cutting blade 130 for mounting the blades on the support shaft 131 to form the cutting blade assembly 128. In particular, the opening 139 is formed centrally of each of the circular cutting blades 130 of the illustrated embodiment. The center of the opening 139 broadly defines a reference point P (FIG. 6C) of the cutting blade 130. Thus, in the illustrated embodiment the reference point P of the cutting blade 130 lies on the longitudinal axis X of the cutting blade assembly 128. However, it is understood that the reference point P of the cutting blade 130 need not lie on the longitudinal axis X of the cutting blade assembly 128 to remain within the scope of this invention.

With reference to FIG. 5 and FIGS. 6A, 6B and 6C, each cutting blade 130 suitably has one or more bumps 142 disposed on at least the first face 132 of the cutting blade. For example, in the illustrated embodiment of FIGS. 6A, 6B and 6C four discrete bumps 142 are disposed on the first face 132 of the cutting blade 130. However, any number of bumps 142 may be disposed on the first face 132 of the cutting blade 130, such as a single bump (e.g., a single discrete bump or a continuous bump), less than four bumps or more than four bumps, without departing from the scope of this invention. In the cutting assembly 128 illustrated in FIG. 5, the first faces 132 of the cutting blades 130 correspond to the left facing faces of the illustrated cutting blades, with the bumps 142 extending outward from the left faces of the cutting blades. However, it is understood that the first faces 132 may instead correspond to the right facing faces of the illustrated cutting blades 130 whereby the bumps 142 extend outward to the right.

In one particularly suitable embodiment, the bumps 142 are formed by stamping dimples 144 into the second face 134 of the cutting blade 130 such that each bump is formed by a corresponding dimple. Alternatively, the bumps 142 may be formed on the first face 132 of the cutting blade 130 other than by stamping dimples 134 into the second face 134, and the dimples may be omitted altogether, without departing from the scope of this invention.

Figure 6A:
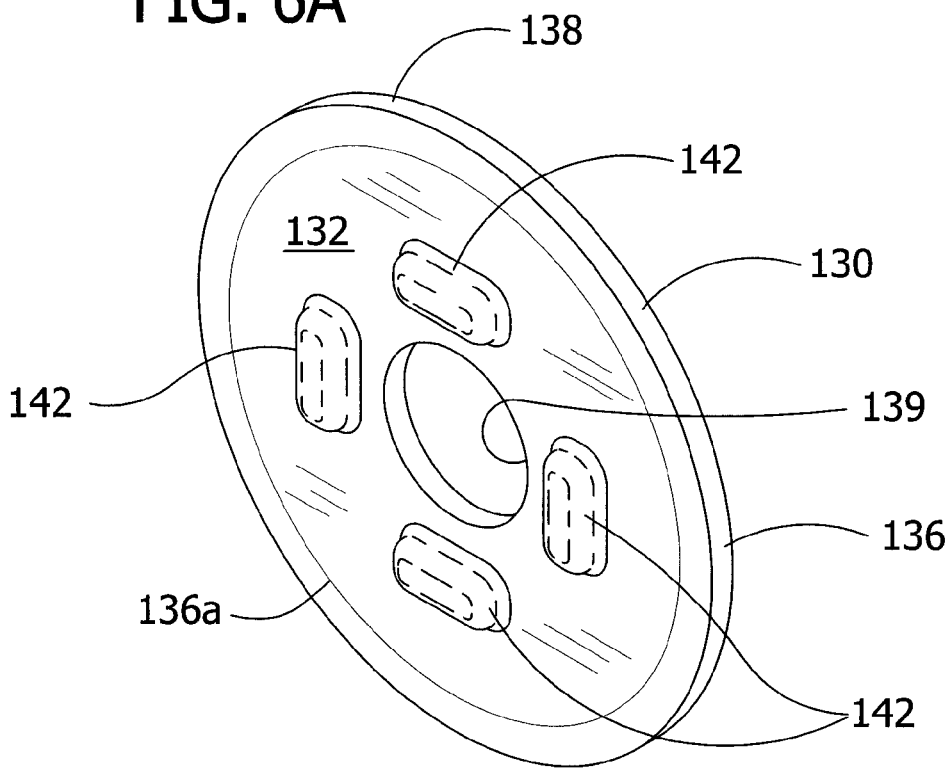
FIG. 6A is a perspective view of one face of a cutting blade of the cutting blade assembly of FIG. 5.
Figure 6B:
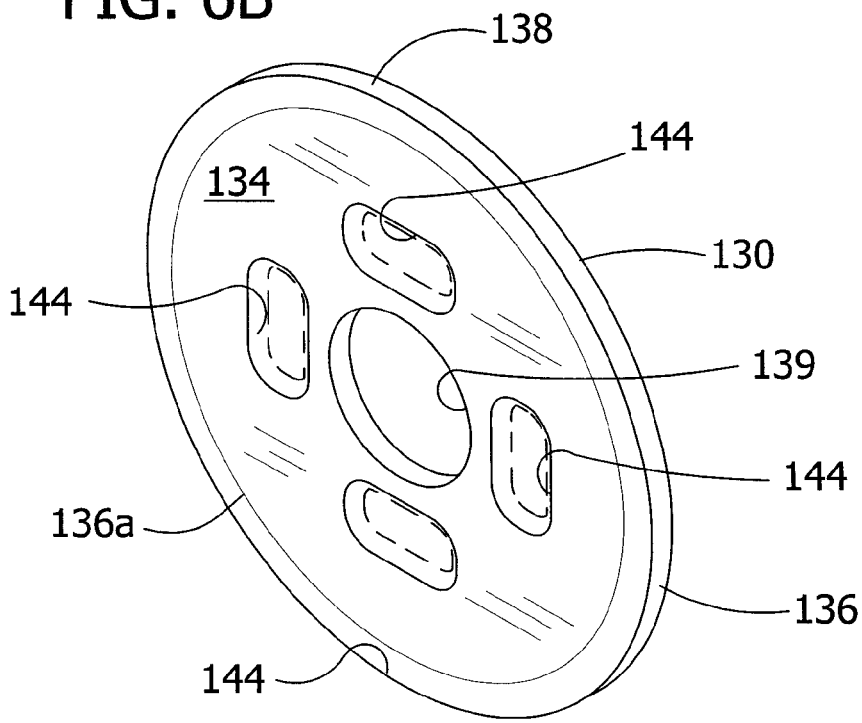
FIG. 6B is a perspective view of the opposite face of the cutting blade.
Figure 6C:
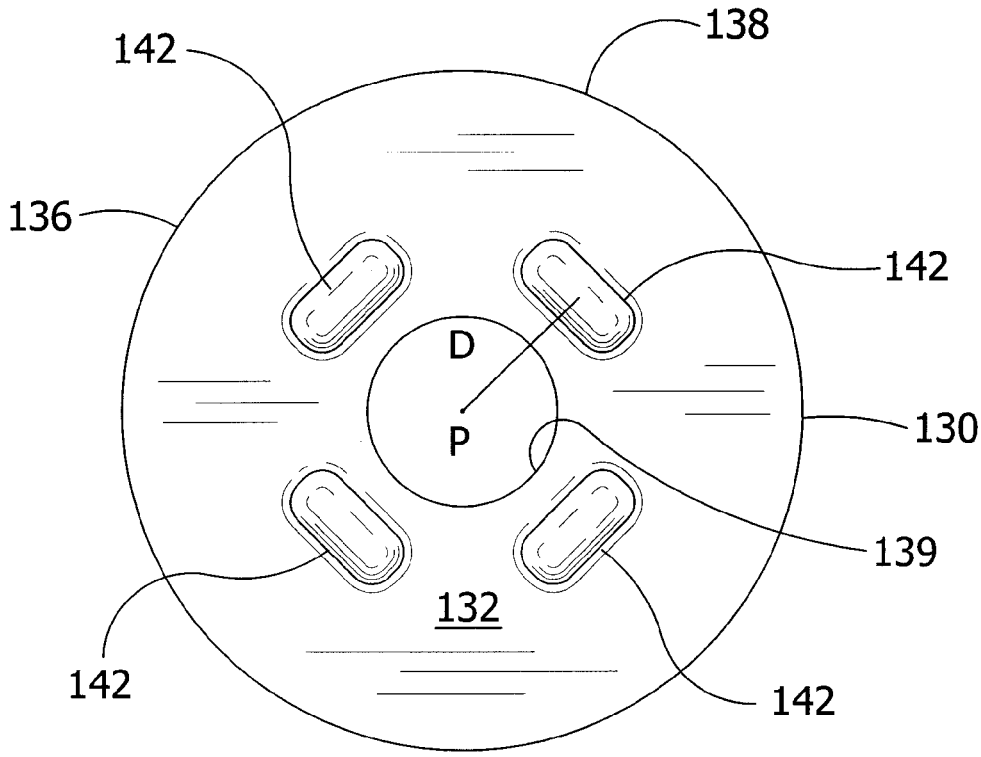
FIG. 6C is a side elevation of the one face of the cutting blade illustrated in FIG. 6A.

The bumps 142 of the cutting blade 130 as illustrated in FIG. 6C each have a generally elongate planar projection (i.e., the projection of the bump into the planar face, such as first face 132, of the cutting blade). In particular, the bumps 142 extend generally tangentially on the first face 132 of the cutting blade 130 in laterally spaced relationship with the reference point P (i.e., the center of the opening 139 in the illustrated embodiment) of the cutting blade 130 and in equally spaced relationship with each other. The term lateral or laterally as used in reference to the cutting blade assembly 128 and/or cutting blade 130 refers to a direction transverse to the longitudinal axis X of the cutting blade assembly, e.g., parallel to the planar faces 132, 134 of each cutting blade. For the circular cutting blades 130 of the illustrated embodiment, laterally means radially.

It is understood that the bumps 142 may instead be of another planar projection shape, such as circular, semicircular, polygonal, or irregular shape. It is also contemplated that the bumps 142 may extend laterally (e.g., radially in the illustrated embodiment) on the first face 132 of the cutting blade 130, or at a skewed angle. Further, one or more bumps 142 on the first face 132 of the cutting blade 130 may have one shape in planar projection while one or more other bumps on the same first face of the cutting blade may have another shape or shapes in planar projection. As illustrated in FIG. 6C, the bumps 142 are suitably spaced inward (i.e., laterally inward) from the peripheral cutting edge 136 to permit coating of the cutting blade adjacent the cutting edge and to further permit shaping of the cutting angle of the cutting edge, if desired.

In accordance with one embodiment of a process of the present invention, the cutting blades 130 are suitably subjected to a coating process subsequent to the bumps being formed but prior to mounting the cutting blades on the cutting blade assembly 128. In particular, the cutting blades are subjected to a coating process in which at least a portion of the first and second faces 132, 134, as well as the peripheral cutting edge 136, of each of the cutting blades are coated with a suitable coating to increase the strength and wear resistance thereof. As an example, the cutting blades 130 may be coated with a titanium nitride compound or other suitable coating composition or material. The coating may be suitably applied by a physical vapor deposition (PVD) process, and more particularly an arc evaporation PVD coating process, which is known to those skilled in the art and is not be further described herein except to the extent necessary to disclose the present invention.

In one particularly suitable embodiment, the first and second faces 132, 134 of each cutting blade 130 are coated only about an annular edge margin extending laterally inward along each respective face from the peripheral cutting edge 136 of the cutting blade. For example, the annular edge margin along which the coating 136*a* is applied to each face 132, 134 of the cutting blade may have a width of about 0.012 inches (about 0.30 mm) . It is understood, however, that a greater portion of each cutting blade face 132, 134 may be coated, including the entirety of each cutting blade face, without departing from the scope of this invention.

Figure 4:
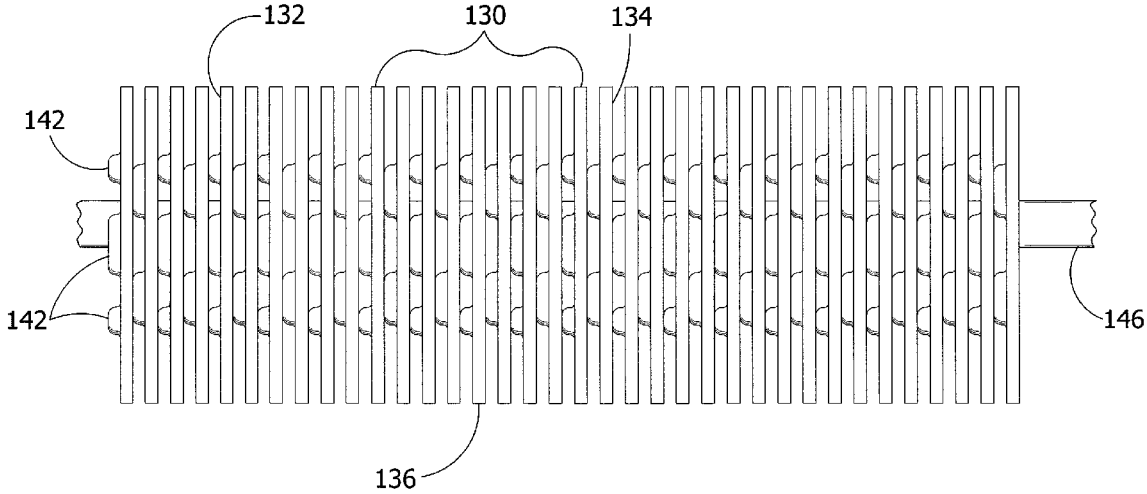
FIG. 4 is a fragmented, front elevation of a plurality of cutting blades constructed in accordance with one embodiment of the present invention and supported by a wire support member for subjecting the cutting blades to a coating process.
Figure 4A:
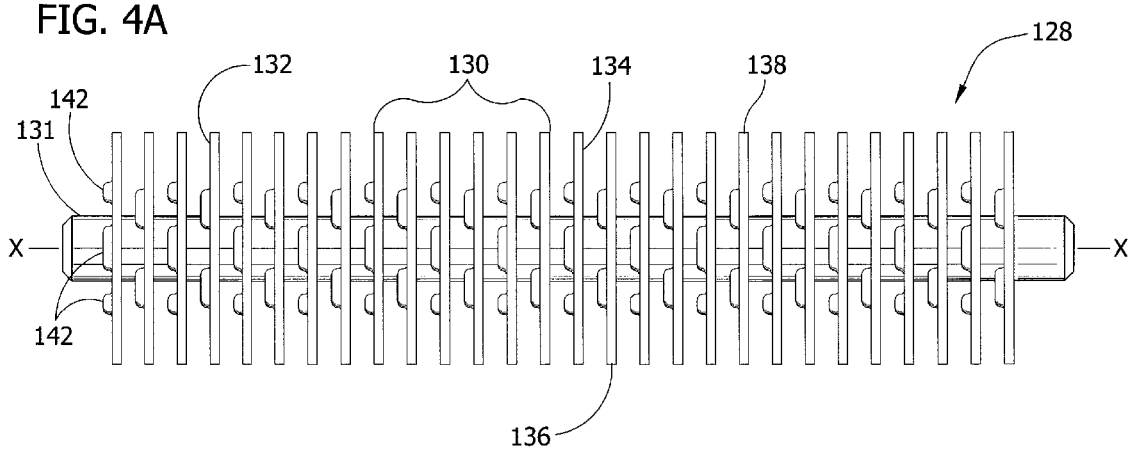
FIG. 4A is a front elevation of a cutting blade assembly according to one embodiment of the present invention for use with an electric shaver such as the foil-type electric shaver of FIG. 1.

With reference now to FIG. 4, to prepare multiple cutting blades 130 for coating of the first and second faces 132, 134, multiple cutting blades are loaded onto a wire 146 (broadly, a support member), rod or other suitably support member sized in cross-section smaller than the openings in the cutting blades. As an example, the number of cutting blades loaded onto the wire 146 for coating may suitably be in the range of about 1,800 to about 2,750. However, more or less cutting blades may be loaded onto the wire 146 without departing from the scope of this invention. The first faces 132 of the cutting blades all face in the same direction (e.g., to the left in the manner illustrated in FIG. 3). It is understood that the blades may be mounted other than on a wire 146 or rod, such as by being seated in a suitable cradle or other suitable support member, and remain within the scope of this invention.

As between adjacent cutting blades 130, the bumps 142 formed on the first face 132 of one cutting blade contact the second face 134 of the adjacent cutting blade to space the adjacent cutting blades a distance substantially equal to the rise of the bumps. As used herein, the rise of the bumps 142 means the height of the apex of the bump relative to the plane of the first face 132 of the cutting blade 130. Accordingly, the bumps 142 equally space the cutting blades 130 from each other and retain the cutting blades on the wire 146 in spaced relationship with each other during coating (i.e., the bumps inhibit stacking together of the blades). As an example, the bumps 142 of the cutting blade 130 illustrated in FIGS. 6A and 6C suitably have a rise of at least about 0.0005 inches (about 0.013 mm), and more suitably at least about 0.001 inches (about 0.025 mm).

Where the bumps 142 are formed by stamping dimples 144 into the second face 134 of the cutting blade 130, there is some risk that the bumps on the first face 132 of one cutting blade may nest in the dimples on the second face of an adjacent cutting blade if the cutting blades are identical and are loaded onto the wire 146 at the same angular orientation. As used herein, the term angular orientation refers to the rotational position of the cutting blade 130 on the wire 145 (or cutting blade assembly 128), such as from 0 to 360 degrees, about the longitudinal axis X of the wire (or cutting blade assembly). Thus, in one embodiment (FIG. 4) adjacent cutting blades 130 are suitably loaded onto the wire 146 at different angular orientations so that the bumps 142 on one cutting blade do not align with the dimples 144 on the adjacent cutting blade.

The cutting blades 130, supported on the wire 146, are then simultaneously subjected to the coating process to coat at least a portion of each of the blades. Where only a portion of each face 132, 134 of each cutting blade 130 is intended to be coated, it is understood that the longitudinally outward facing faces of the two end blades of the multiple blades being coated may be coated entirely. Following coating of the cutting blades 130, the cutting blades are removed from the wire 146 and mounted on the support shaft 131 in the manner shown in FIG. 5 to form the cutting blade assembly 128.

As mounted on the support shaft 131, the cutting blades 130 are suitably spaced from each other at a pitch such that the bumps 142 disposed on the first faces 132 of the cutting blades are spaced from (i.e., not in contact with) the second faces 134 of the adjacent cutting blades. In such an embodiment, the angular orientations of the cutting blades 130 in the cutting blade assembly 128 may be the same or different within the scope of this invention. Alternatively, the bumps 142 on the first faces 132 of the cutting blades 130 may contact the second faces 134 of the adjacent cutting blades, with each cutting blade suitably being at a different angular orientation than the adjacent cutting blade.

Figure 7A:
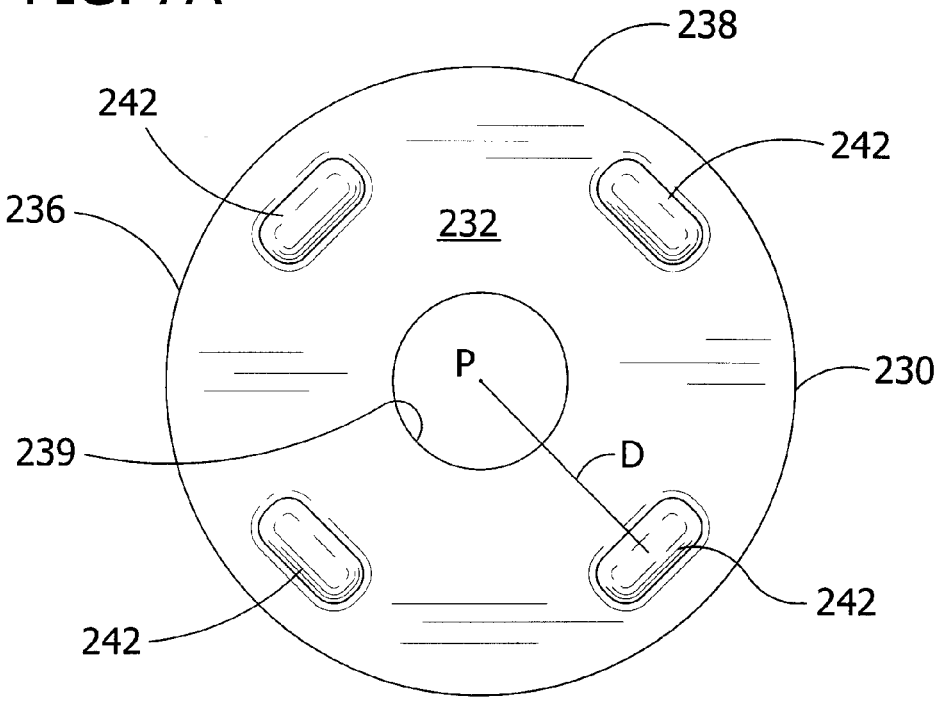
FIG. 7A is a side elevation of one face of a second embodiment of a cutting blade of the present invention.
Figure 7B:
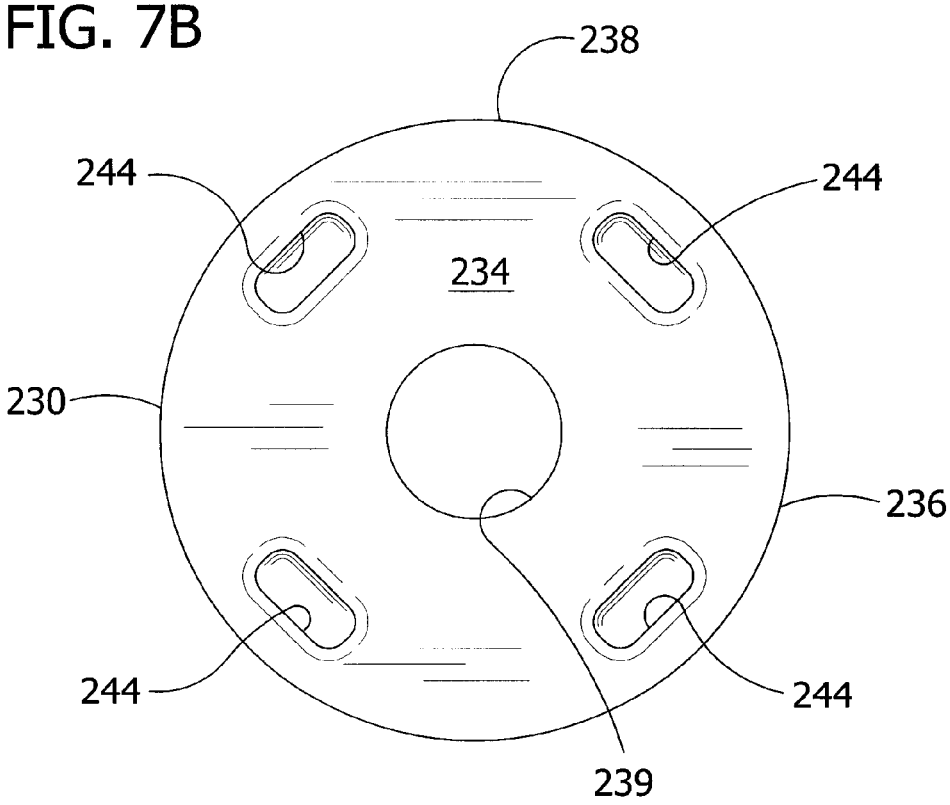
FIG. 7B is a side elevation of the opposite face of the cutting blade of FIG. 7A.

In an alternative embodiment illustrated in FIGS. 7A and 7B, the dimples 244 and bumps 242 on one cutting blade 230 are suitably formed at different positions relative to the reference point P of the cutting blade than the dimples 144 and bumps 142 on the adjacent cutting blade 130 (such as the cutting blade 130 of FIGS. 6A, 6B and 6C). For example, the cutting blade 230 illustrated in FIG. 7A has bumps 244 and corresponding dimples 242 (not shown) formed at a distance D from the reference point P (i.e., from the center of the opening 239 of the circular cutting blade illustrated in Fig. X) greater than the distance D of the bumps 142 and corresponding dimples 144 of the cutting blade 130 of FIG. 4C.

As an example, the cutting blades 130, 230 illustrated in FIGS. 6C and 7A each have a diameter of about 0.275 inches (about 6.99 mm). The bumps 142 on the cutting blade 130 of FIG. 6C are spaced from the reference point P a distance D (as measured from the reference point to the center of the bump) of about 1.88 mm. The bumps 242 on the cutting blade 230 of FIG. 7A are spaced from the reference point P a distance D of about 0.103 inches (about 2.62 mm). It is understood, however, that the distance D at which the bumps 142, 242 are spaced from the reference point P of the cutting blade 130, 230 may be other than in the illustrated embodiment without departing from the scope of this invention.

Figure 8:
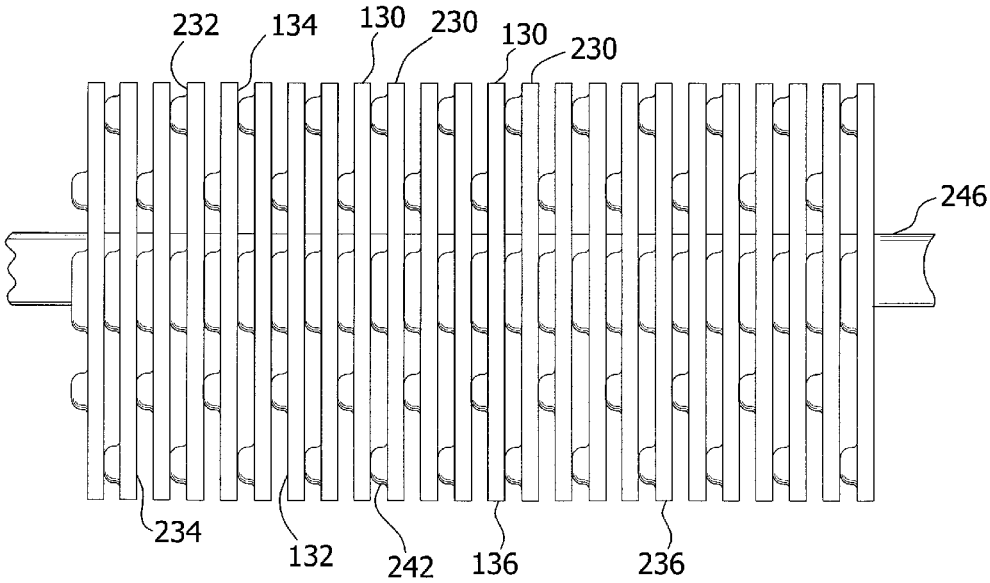
FIG. 8 is a fragmented front elevation of a plurality of cutting blades constructed in accordance with a second embodiment of the present invention and supported by a wire support member for subjecting the cutting blades to a coating process.

As illustrated in FIG. 8, to prepare the cutting blades 130, 230 for the coating process, the cutting blades are suitably loaded onto the wire 246 with adjacent cutting blades having bumps 142, 242 at different distances relative to the reference point P of the blades. For example, the first cutting blade 130 may be the blade shown in FIG. 6C, the second blade 230 may then be the blade shown in FIG. 7A, then another FIG. 6C cutting blade, then another FIG. 7A cutting blade, etc. In such an arrangement, the bumps 142, 242 formed on the first face 132, 232 of one cutting blade 130, 230 will not align with (and will therefore not nest within) the dimples 144, 244 formed in the second face 134, 234 of the adjacent cutting blade.

Figure 9:
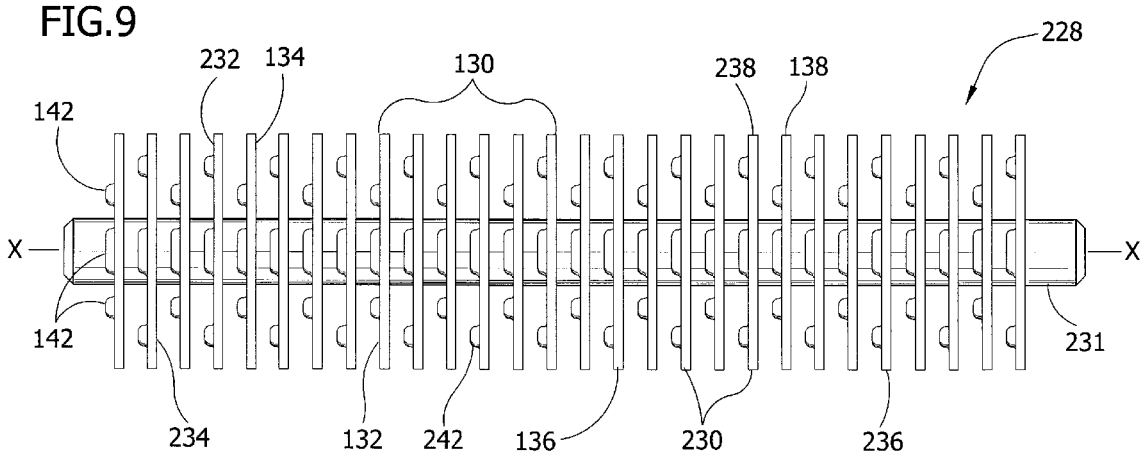
FIG. 9 is a front elevation of a cutting blade assembly according to a second embodiment of the present invention.

Following coating of the cutting blades 130, 230, the cutting blades are removed from the wire 246 and mounted on a support shaft 231 as shown in FIG. 9 in laterally spaced relationship with each other so that the bumps 142, 242 of each blade are spaced from (i.e., not in contact with) the second face 134, 234 of the adjacent cutting blade. Alternatively, the cutting blades 130, 230 may be more closely spaced such that the bumps 142, 242 of each cutting blade contact the second face 134, 234 of the adjacent cutting blade.

The cutting blades (e.g., the blades 130 of the cutting assembly 128 of FIG. 5 or the blades 130, 230 of the cutting assembly 228 of FIG. 9) may then be subjected to suitable finishing processes, such as removing material from the peripheral cutting edge 136, 236 of each cutting blade (at least along the segment that is intended to contact the inner surface of the apertured foil 24). It is contemplated that the material removal process may suitably be conducted on the cutting blades 130, 230 while the blades are mounted on the support shaft 231, or on each individual cutting blade prior to mounting on the support shaft.

Also, while the cutting blades 130, 230 illustrated and described herein each comprise a single peripheral cutting edge 136, 236 (e.g., such that two discrete cutting blade assemblies are required in the shaver 20 of FIG. 1 having two apertured foils 24), it is contemplated that a single cutting blade assembly having a plurality of unitary cutting blades (not shown) having two cutting edges (e.g., one corresponding to each of the apertured foils) may be used in accordance with the present invention. Such a unitary blade configuration is disclosed in co-assigned U.S. Pat. No. 5,138,767 (Locke), the entire disclosure of which is incorporated herein by reference to the extent that it is consistent herewith. It is also understood that only one cutting blade assembly 128, 228 or more than two cutting blade assemblies, may be used in accordance with the present invention.

When introducing elements of the invention or the preferred embodiments thereof, the articles "a", "an", "the" and "said" are intended to mean that there are one or more of the elements. The terms "comprising", "including", and "having" are intended to mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

The invention claimed is:

1. A cutting blade for an electric shaver cutting blade assembly, said cutting blade assembly comprising at least two of said cutting blades, said cutting blade having a generally planar first face, a generally planar second face opposite the first face, and a peripheral cutting edge, said cutting blade further having at least one closed bump on said first face spaced laterally inward from the peripheral cutting edge.

2. The cutting blade set forth in claim 1 wherein the cutting blade has at least one dimple in the second face thereof, said at least one dimple corresponding to said at least one bump on the first face of the cutting blade.

3. The cutting blade set forth in claim 1 wherein the cutting blade assembly has a longitudinal axis, the cutting blade having a reference point that at least in part defines the longitudinal axis of the cutting blade assembly, the first face of the cutting blade having at least two closed bumps thereon, said at least two closed bumps being spaced laterally inward from the peripheral cutting edge and spaced equidistant from the reference point of the cutting blade.

4. The cutting blade set forth in claim 1 wherein the at least one bump is elongate.

5. The cutting blade set forth in claim 4 wherein the cutting blade has a generally circular planar projection having a radius, the at least one bump extending generally tangentially relative to the radius of the cutting blade.

6. The cutting blade set forth in claim 1 wherein the at least one bump has a rise of at least about 0.013 mm.

7. A cutting blade assembly for an electric foil shaver, said cutting blade assembly comprising a first cutting blade having a generally planar first face, a generally planar second face opposite the first face, and a peripheral cutting edge, said first cutting blade having at least one closed bump disposed on said first face spaced laterally inward from the peripheral cutting edge; and a second cutting blade having a generally planar first face, a generally planar second face opposite the first face, and a peripheral cutting edge;

said first and second cutting blades being arranged in the cutting blade assembly in generally parallel relationship with each other and with the first face of the first cutting blade facing one of the first face and the second face of the second cutting blade.

8. The cutting blade assembly set forth in claim 7 wherein the second cutting blade has at least one bump disposed on the first face thereof spaced laterally inward from the peripheral cutting edge, said first and second cutting blades being arranged in the cutting blade assembly with the first face of the first cutting blade facing the second face of the second cutting blade.

9. The cutting blade assembly set forth in claim 7 wherein the first and second cutting blades are arranged in the cutting blade assembly in generally parallel relationship with each other and with the first face of the first cutting blade facing the second face of the second cutting blade, said second face of the second cutting blade being spaced from the at least one bump on the first face of the first cutting blade.

10. The cutting blade assembly set forth in claim 7 wherein the first cutting blade has at least one dimple in the second face of said first cutting blade, said at least one dimple corresponding to said at least one bump on the first face of said first cutting blade.

11. The cutting blade assembly set forth in claim 7 wherein the at least one bump has a rise of at least about 0.013 mm.

12. The cutting blade assembly set forth in claim 7 wherein at least a portion of the first face of the first cutting blade is coated with a coating, at least a portion of the second face of the first cutting blade is coated with said coating, at least a portion of the first face of the second cutting blade is coated with said coating and at least a portion of the second face of the second cutting blade is coated with said coating.

13. The cutting blade assembly set forth in claim 8 wherein the cutting blade assembly has a longitudinal axis and the second cutting blade is substantially identical to the first cutting blade, the first and second cutting blades being arranged longitudinally in the cutting blade assembly, the first cutting blade being at a first angular orientation about the longitudinal axis of the cutting assembly and the second cutting blade being at a second angular orientation about the longitudinal axis of the cutting assembly different from the first angular orientation of the first cutting blade.

14. The cutting blade assembly set forth in claim 8 wherein the cutting blade assembly has a longitudinal axis and a lateral axis, the first and second cutting blades being arranged in parallel relationship with each other on the longitudinal axis of the cutting blade assembly, the at least one bump of the first face of the first cutting blade being disposed at a first lateral distance from the longitudinal axis of the cutting blade assembly, the at least one bump of the first face of the second cutting blade being disposed at a second lateral distance from the longitudinal axis of the cutting blade assembly, said second lateral distance being different from said first lateral distance.

15. The cutting blade assembly set forth in claim 8 wherein the first cutting blade has at least one dimple in the second face of said first cutting blade, said at least one dimple corresponding to said at least one bump on the first face of said first cutting blade, said at least one second cutting blade having at least one dimple in the second face of said second cutting blade and corresponding to said at least one bump on the first face of the second cutting blade.

16. The cutting blade assembly set forth in claim 8 wherein the at least one bump disposed on the first face of the second cutting blade is a closed bump.

17. The cutting blade assembly set forth in claim 12 wherein the coating is at least in part titanium nitride.

18. The cutting blade assembly set forth in claim 12 wherein the first face of the first cutting blade has an edge margin extending inward from the peripheral cutting edge of said first cutting blade and being coated by said coating, a remaining portion of the first face of the first cutting blade inward of said edge margin being substantially uncoated by said coating.

19. The cutting blade assembly set forth in claim 18 wherein the second face of the first cutting blade has an edge margin extending inward from the peripheral cutting edge of said first cutting blade and being coated by said coating, a remaining portion of the second face of the first cutting blade inward of said second face edge margin being substantially uncoated by said coating.

20. A cutting blade assembly for an electric foil shaver, said cutting blade assembly having a longitudinal axis and comprising a first cutting blade having a generally planar first face, a generally planar second face opposite the first face, and a peripheral cutting edge, said first cutting blade having at least one bump disposed on said first face; and a second cutting blade having a generally planar first face, a generally planar second face opposite the first face, and a peripheral cutting edge, the second cutting blade having at least one bump disposed on the first face thereof;

said first and second cutting blades being arranged longitudinally in the cutting blade assembly in generally parallel relationship with each other and with the first face of the first cutting blade facing the second face of the second cutting blade, wherein the second cutting blade is substantially identical to the first cutting blade, the first cutting blade being at a first angular orientation about the longitudinal axis of the cutting blade assembly and the second cutting blade being at a second angular orientation about the longitudinal axis of the cutting blade assembly, the second angular orientation being different from the first angular orientation.

21. A cutting blade assembly for an electric foil shaver, said cutting blade assembly having a longitudinal axis and comprising a first cutting blade having a generally planar first face, a generally planar second face opposite the first face, and a peripheral cutting edge, said first cutting blade having at least one bump disposed on said first face spaced laterally inward from the peripheral cutting edge and at least one dimple in the second face, said at least one dimple corresponding to said at least one bump; and a second cutting blade having a generally planar first face, a generally planar second face opposite the first face, and a peripheral cutting edge;

said first and second cutting blades being arranged longitudinally in the cutting blade assembly in generally parallel relationship with each other and with the first face of the first cutting blade facing one of the first face and the second face of the second cutting blade.

* * * * *